US008394003B2

(12) United States Patent
Weinstock

(10) Patent No.: US 8,394,003 B2
(45) Date of Patent: Mar. 12, 2013

(54) HANDHELD FINGER MANIPULATING DEVICE

(76) Inventor: David M. Weinstock, Edmonds, WA (US)

( * ) Notice: Subject to any disclaimer, the term of this patent is extended or adjusted under 35 U.S.C. 154(b) by 557 days.

(21) Appl. No.: 12/771,825

(22) Filed: Apr. 30, 2010

(65) Prior Publication Data

US 2010/0279826 A1 Nov. 4, 2010

Related U.S. Application Data

(60) Provisional application No. 61/174,781, filed on May 1, 2009.

(51) Int. Cl.
*A63B 21/00* (2006.01)

(52) U.S. Cl. ..... 482/47; 482/49; 482/46; 84/465

(58) Field of Classification Search ..... 482/47, 482/46, 44, 26; 84/465
See application file for complete search history.

(56) References Cited

U.S. PATENT DOCUMENTS

2003/0073939 A1* 4/2003 Taylor et al. ..... 601/40
2008/0026915 A1* 1/2008 Chuang et al. ..... 482/44
2010/0261581 A1* 10/2010 Bearden ..... 482/47

* cited by examiner

*Primary Examiner* — Jerome W Donnelly
(74) *Attorney, Agent, or Firm* — Dean A. Craine

(57) ABSTRACT

A handheld finger manipulating device comprising an elongated plunger assembly that moves longitudinally through a longitudinally aligned bore formed on an outer body. The elongated member is longer than the outer body so that when one end of the plunger body is forced into the outer body, the opposite end of the plunger assembly is extended beyond the opposite end of the outer body. At least one magnet and two magnetic attractive substrates are located between the plunger assembly and the outer body that enables the plunger assembly to move to two preset locations within the outer body. During use, the user holds the device in his or her palm and presses against one end of the plunger assembly to forcibly move it through the outer body. As the plunger assembly moves through the outer body, the magnet and the substrates interact to create a slow and then sudden acceleration of the plunger assembly. In other embodiments, enhanced sound and light producing elements are provided.

13 Claims, 5 Drawing Sheets

HANDHELD FINGER MANIPULATING DEVICE

This utility patent application is based and claims the benefit of U.S. provisional patent application (Ser. No. 61/174,781) filed on May 1, 2009.

BACKGROUND OF THE INVENTION

1. Field of the Invention

This invention relates to handheld finger manipulative devices that are designed to be used repeatedly during mental focusing and as a hand and finger exerciser.

2. Description of the Related Art

Some individuals are better able to relax and mentally focus or concentrate if they are simultaneously engaged in some sort of sound producing, kinesthetic activity with their hands. Snapping one's fingers or cracking one's knuckles, or 'clicking a pen' are examples of such activities. Unfortunately, nearby individuals may find these activities annoying.

Individuals suffering hand and finger injuries need devices that will allow them to exercise their fingers and hands to promote nerve regeneration and to increase finger muscle strength, flexibility and coordination. Ideally, such devices should be relatively small so that they can be used inconspicuously in the hand and be temporarily stored in a pocket.

SUMMARY OF THE INVENTION

Disclosed herein is a small handheld finger manipulator device intended to provide relatively low sound and tactile feedback for those individuals who find such devices useful for improved focusing and concentration or for finger and hand medical rehabilitation.

The device is relatively small and designed to be held in one hand and used repeatedly to manipulate and exercise different sets of fingers. During use, the user uses his or her fingers to move a long, narrow plunger assembly longitudinally back and forth through the shorter outer body using a different set of fingers. Every time the plunger assembly moves through the outer body, a sudden acceleration and soft impact sensation is produced which is felt in the hand. In some instances, a soft 'clicking' sound may be produced as the plunger moves back and forth in the outer body.

Disposed between the plunger assembly and the outer body is at least one magnet and a pair of magnetic attractive substrates. When the plunger assembly moves through the outer body, the magnet and one magnet attractive substrate temporarily holds the plunger assembly so that one end of the plunger assembly is extended from the outer body. When light longitudinal pressure is applied to the extended end of the plunger assembly, the attractive magnetic force that holds the plunger assembly in an extended position is overcome. The plunger assembly then moves longitudinally through the outer body until a second magnet and substrate pairing creates a suddenly acceleration of the plunger assembly which then forces the opposite end of the plunger assembly through the outer body.

In various embodiments disclosed herein, various arrangements of magnets and the magnetic attractive substrates are used to create two magnetic forces that move the plunger assembly back and forth in the outer body. In the first embodiment, the plunger member is an I-shaped structure with two magnets located in two opposite end caps. Located inside the outer body are two fixed, transversely aligned steel washers. As the plunger assembly moves back and forth longitudinally inside the outer body, the two magnets in the end caps are magnetically attracted to the nearest steel washer.

In a second embodiment, the plunger member includes two end caps coupled to the opposite ends of a larger, cylindrical, center magnet. Two steel compression rings are transversely aligned inside the central bore and near the opposite ends of the outer body. As the plunger assembly moves longitudinally back and forth inside the outer body, the magnet interacts with one of the two compression rings so that one end of the plunger assembly is extended from the outer body. In a third embodiment, optional means for generating sound and light when the plunger assembly is moved are provided.

In summary, a handheld finger manipulator device is disclosed that includes a cylindrical outer body designed to fit entirely into the palm of a hand of a user. The outer body includes a center bore and two opposite ends. Located inside the center bore is a cylindrical plunger assembly longer than the outer body that includes two opposite ends. When assembled, one end of the plunger assembly is retracted into the outer body, the opposite end of the plunger assembly is extended. A first means for generating a magnetic force is disposed between the outer body and the plunger assembly that causes the plunger assembly to sufficiently move longitudinally inside the center bore so that one end of the plunger assembly extends from the outer body and the opposite end of the plunger assembly is retracted within the outer body. A second means for generating a magnetic force is disposed between the outer body and said plunger assembly that causes the plunger assembly to move longitudinally inside the center bore and in the opposite direction of movement caused by the first means for generating a magnetic force. The size and shape of the outer body, the plunger assembly and the first and second means for generating a magnetic force and the relative locations of the first and second means for generating a magnetic force must allow each magnetic force created thereby to be isolated. When the plunger assembly is held with one end extended from the outer body, only one magnetic force holds the plunger assembly in place in the center bore. When a force is exerted on the extended end, the plunger assembly moves inward and the magnetic force resisting movement gradually dissipates. As the plunger assembly continues to move inward, the second magnetic force gradually increases and then 'pulls' the plunger assembly through the center bore until the opposite end of the plunger assembly extends form the opposite end of the outer body.

DESCRIPTION OF THE PREFERRED EMBODIMENT(S)

Figure 15A:
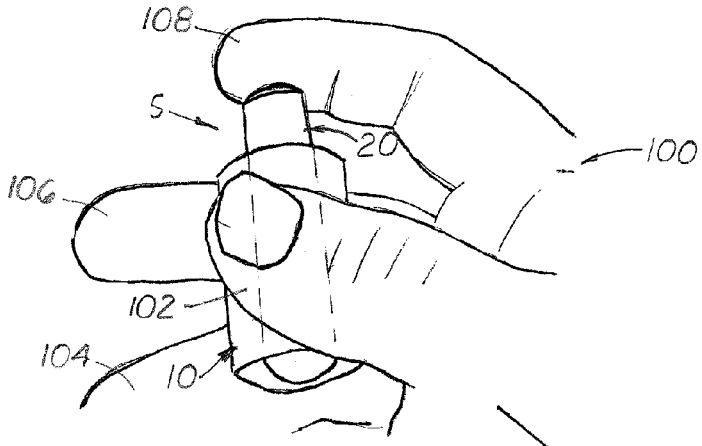
FIGS. 15A-C are illustrations showing the device being held the user's hand with the plunger assembly being moved back and forth through the outer body using his or her fingers.
Figure 15B:
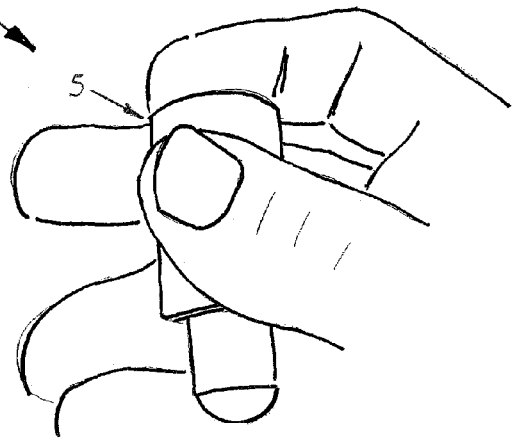
Figure 15C:
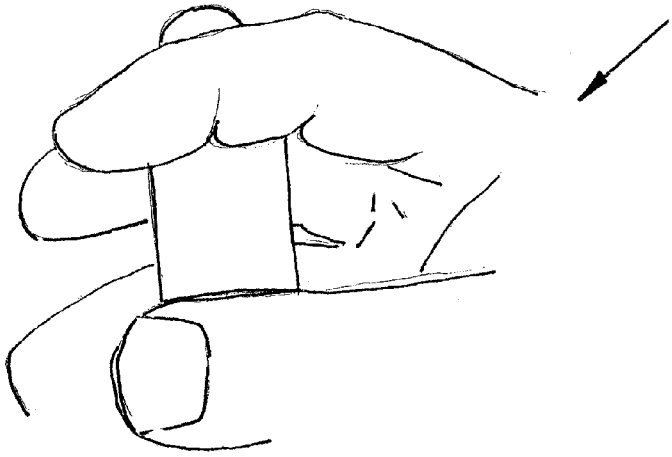

FIGS. 15A-C shows a small finger manipulator device 5 designed to be held in one hand 100 and used repeatedly to manipulate and exercise different fingers 102, 104, 106, 108. The device 5, which is designed to fit in a hand 100, includes a long plunger assembly 20 which moves longitudinally through a shorter cylindrical outer body 10. During use, the user moves the plunger assembly 20 longitudinally back and forth through the outer body 10 using different fingers 102, 104, 106, 108. Every time the plunger assembly 20 moves through the outer body 10, a smooth, sudden, short acceleration followed by a soft impact sensation are produced.

Referring to FIGS. 1-4, a first embodiment of the device 5 is shown that consists of a hollow, cylindrical outer body 10 with a center bore 14 formed therein. Located inside the center bore 14, is an inner plunger assembly 20 that is designed to move longitudinally a predetermined distance through the outer body 10. As shown more clearly in FIG. 3, the outer body 10 includes an outer sleeve 12 with a center landing 16 located centrally and transversely inside the center bore 14 which acts as two stop surfaces for two steel washers 18, 18'. The two washers 18, 18' are securely attached to the opposite inside surfaces of the center landing 16. The center landing 16 and the two washers 18, 18' each include center bores 17, and 19, 19', respectively, which enable the two posts 26, 26' affixed to the two end caps 21, 21', respectively, to extend through.

The plunger assembly 20 includes two opposite magnetic end caps 21, 21' coupled together by a spring 22. Each end cap 21, 21' includes a cylindrical magnet housing 24, 24' designed to move longitudinally inside the cavities in the center bore 14 located on opposite sides of the center landing 16. Located on the inside surface of each magnet housing 24, 24' is a transversely aligned flat, circular magnet 28, 28', respectively. Attached to each magnet housing 24, 24' is a narrow, coaxially aligned center post 25, 25', respectively. During assembly, the plunger assembly 20 is longitudinally aligned with the center bore 14 so that the two end caps 21, 21' may extend through the opposite ends of the outer sleeve 12. The compression spring 22 is then attached to the one center post 25 and the other center post 25' is aligned and registered with the spring 22 and force thereon to couple the two end caps 21, 21'. Unlike the other plunger assemblies described further below, plunger assembly 20 is not designed to be removable from the outer body 10.

The depth of the end cap receiving space formed on the outer sleeve 12 and the height of the end caps 21, 21' are sufficient so that the end caps 21, 21' may fully retract into the outer body 12. The inside surface of the magnet housing 24, 24' is flat thereby enabling them to rest adjacent to the steel washers 18, 18' attached to the center landing 16. Also, the lengths of the center posts 26, 26' are sufficient so when one end cap 21 or 21' is pressed into one end cap cavity, the opposite end cap 21 or 21' is forced outward through the opposite end of the outer housing 12. The lower edge of the end cap 21 or 21' that extends from the outer sleeve 12 however, is still captured by the center bore 14. Attached to each magnet housing 29 is an end cap cover 30, 30', respectively.

Figure 1:
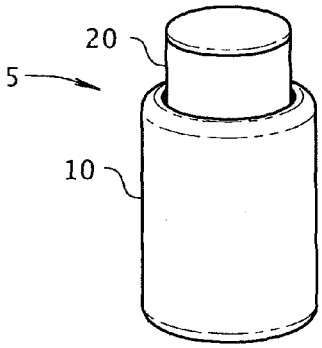
FIG. 1 is a perspective view of the first embodiment of the handheld finger manipulator device.
Figure 2:
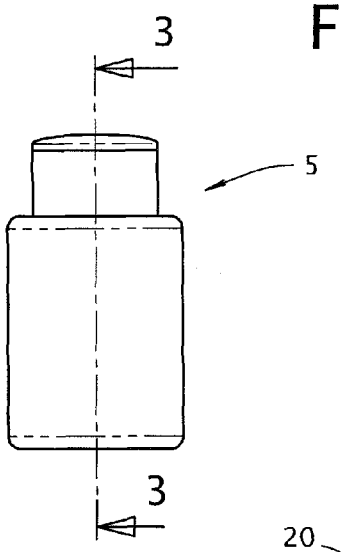
FIG. 2 is a side elevation view of the handheld finger manipulator device shown in FIG. 1.
Figure 3:
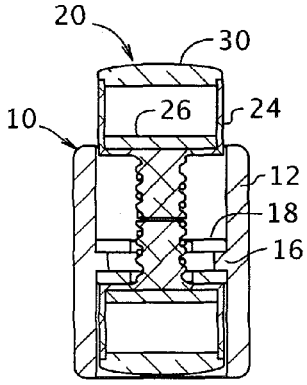
FIG. 3 is a sectional, side elevation view of the handheld finger manipulator device shown along line 3-3 in FIG. 3.
Figure 4:
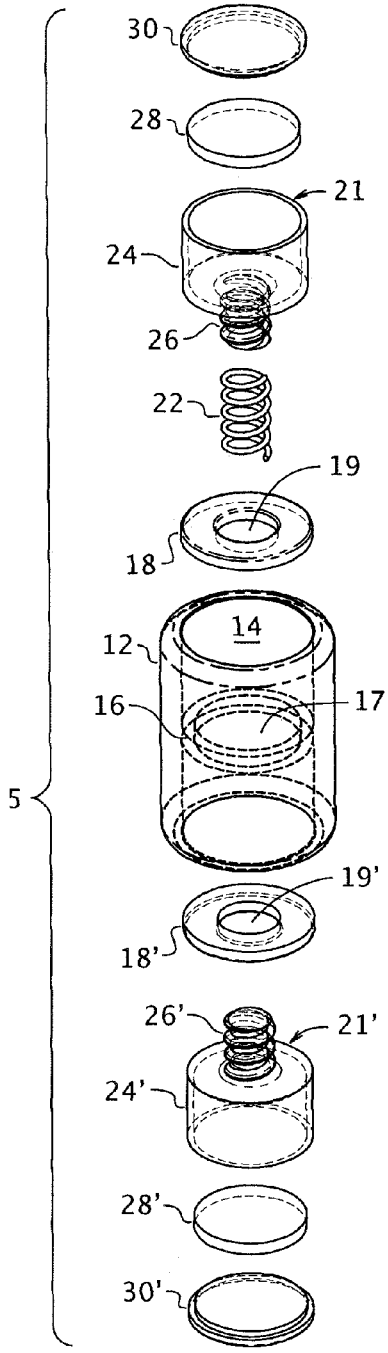
FIG. 4 is an exploded, perspective view of the handheld finger manipulator device shown in FIG. 1.
Figure 5:
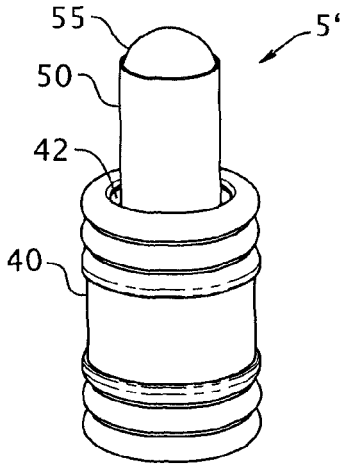
FIG. 5 is a perspective view of a second embodiment of the handheld finger manipulator device.
Figure 6:
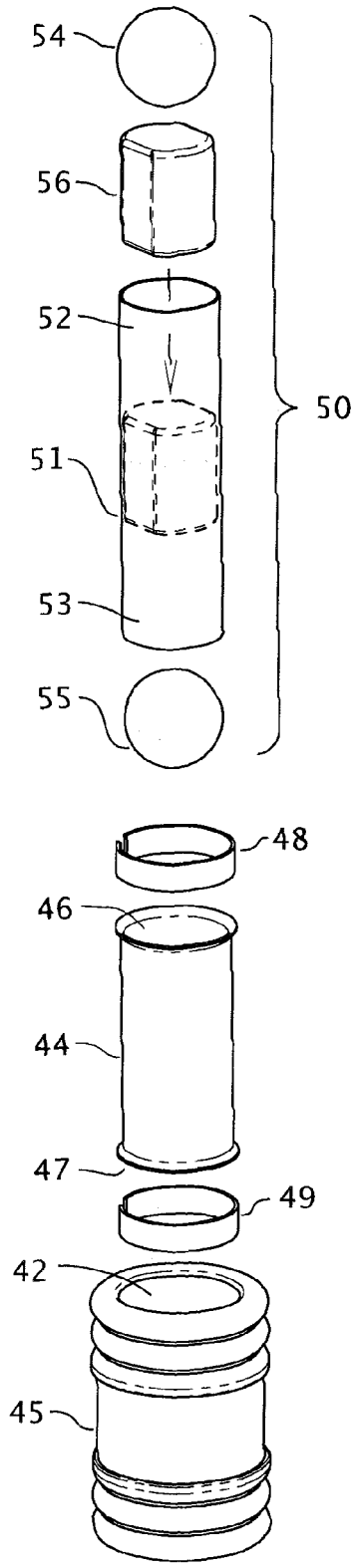
FIG. 6 is an exploded perspective view of the handheld finger manipulator device shown in FIG. 5.
Figure 7:
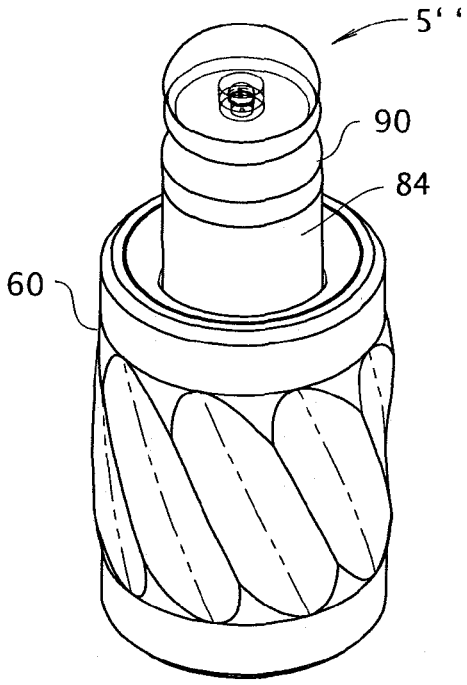
FIG. 7 is a perspective view of a third embodiment of the handheld finger manipulator device.
Figure 8:
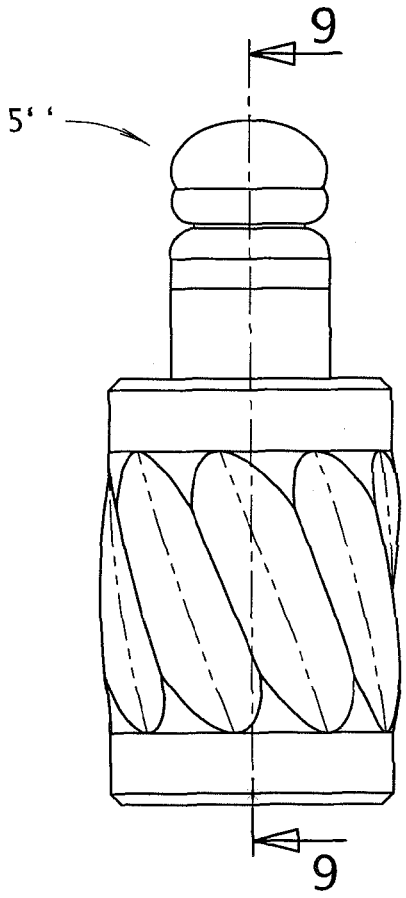
FIG. 8 is a side elevation view of the third embodiment of the handheld finger manipulator device shown in FIG. 6.
Figure 9:
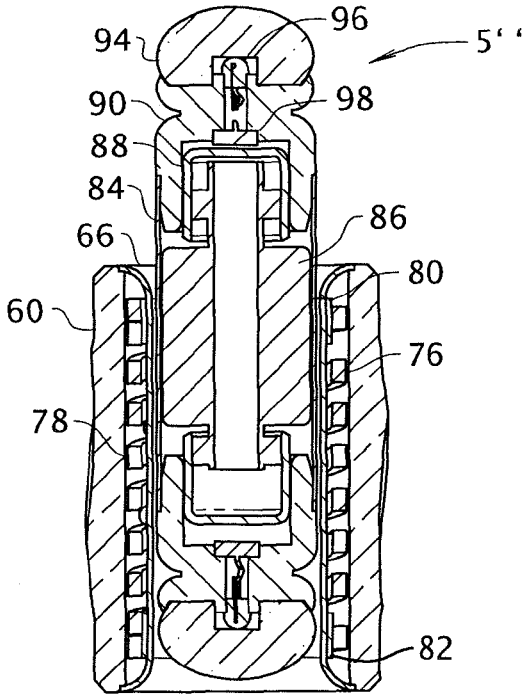
FIG. 9 is a sectional, side elevation view of the handheld finger manipulator device shown along line 9-9 in FIG. 8.
Figure 10:
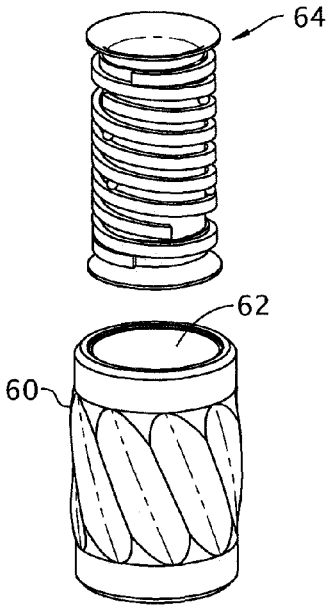
FIG. 10 is a perspective view of the outer housing and the inner coil assembly used on the third embodiment of the device.
Figure 11:
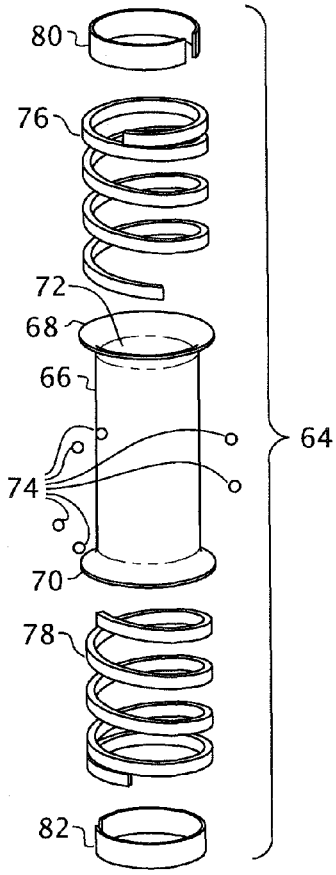
FIG. 11 is an exploded perspective view of inner coil assembly showing the relative locations of the two tonal coils, the ball bearings, and the two compression rings.
Figure 12:
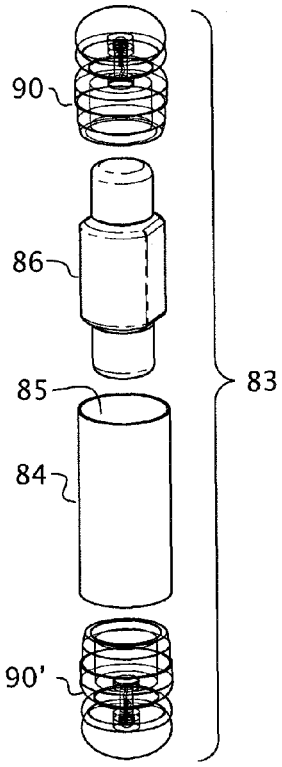
FIG. 12 is an exploded view of the plunger assembly used on the third embodiment of the device.
Figure 13:
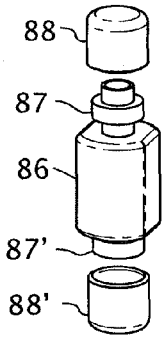
FIG. 13 is an exploded perspective view of the magnetic rotator assembly.

FIGS. 5 and 6 show a second embodiment of the device, generally indicated by the reference number 5', that includes a cylindrical outer body 40 with a center bore 41 with two end openings 42, 43. Located inside the center bore 41 is a hollow outer sleeve 44 also with a center bore 45 with two end openings 46, 47. Attached to the outer sleeve 44 adjacent to the end openings 46, 47 are two steel compression rings 48, 49, respectively.

Disposed inside the center bore 45 of the outer sleeve 44 is a plunger assembly 50 that includes an inner sleeve 51 with a cylindrical shaped magnet 56 affixed centrally inside the inner sleeve 50. Attached to the opposite ends 52, 53 of the inner sleeve 51 are two spherical end caps 54, 55. During operation, the inner sleeve 51 moves longitudinally in the center bore 45 which also moves the magnet 54 within the outer sleeve 44 adjacent to one of the compression rings 48, 49. Like the first embodiment, the outer body 40 and the inner sleeve 51 are sufficient in length so that when one end cap 54 or 55 extends above the outer body 40, the opposite end cap 54 or 55 is forced into the outer body 40 and the opposite end cap 54, 55 is retracted inside the outer body 40. When one end cap 54 or 55 is extended, the magnet 54 is magnetically attracted to the compression ring 46 or 48 located adjacent to the end opening 42 or 44 through which the plunger assembly 50 extends. When sufficient force to overcome the magnetic force between the magnet 56 and the compression ring 48 or 49 is applied longitudinally to the exposed end cap 54, 55, the plunger assembly 50 is forced into the outer body 40. When the magnet 54 approaches the compression ring 46 or 48, located near the opposite end opening 42 or 44, the magnetic attractive forces suddenly accelerate the plunger assembly 50 into the outer body 40. Because the plunger assembly 50 has momentum, the plunger assembly 50 undergoes a slight rebound action when the magnet 54 is adjacent to the compression ring 46, 48.

One purpose of the outer sleeve 44 is to hold the two compression rings 48, 49 in a fixed location near the opposite ends of the open ends 41, 42 of the outer body 40. It should be understood that the outer sleeve 44 may be eliminated and that the two compression rings 48, 49 could be mounted in transverse, circular, recessed grooves (not shown) formed near the open ends 42, 43.

The two spherical end caps 54, 55 may have a diameter slightly larger than the outer sleeve 44 so that when the plunger assembly 50 moves back and forth through the outer body 40, the spherical end caps 54, 55 impact the outer openings of the outer sleeve 44 and create a 'clicking' sound.

FIGS. 7-14 show a third embodiment of the invention of the device, indicated by the reference number 5" that includes a hollow, cylindrical outer body 60 with a center bore 61. Disposed inside the outer body 60 is a sound and tactile generator 64. Mounted over the opposite ends of the outer body 60 are two steel compression rings 80, 82 which during operation, act as magnetic attractive substrates for the magnet 86 on the plunger assembly 83.

The outer sleeve 66 includes two opened, large flared ends 68, 70. The length of the outer sleeve 66 is substantially identical to the outer body 60 and the edges of the flared ends 68, 70 extend outward to capture and hold the two compression rings 80, 82 and the two tonal rings 76, 78 in a fixed position. The middle section of the outer sleeve 66 between the two flared ends 68, 70 has a diameter substantially smaller that the center bore 61 thereby creating a space between the middle section of the outer sleeve 66 and the inside wall of the center bore 61.

Disposed around the center section of the outer sleeve 66 are two interconnected, fixed tonal springs 76, 78. Located between the leaves of the two tonal springs 76, 78 is a plurality of steel ball bearings 74 that cause the magnet 86 to rotate inside the outer tube 66 as the plunger assembly 83 moves longitudinally through it. In addition, the movement of the ball bearings 74 against the two tonal springs 76, 78 creates a unique rolling or grinding sound and a vibration inside the outer body 60.

Disposed inside the outer tube 66 is a plunger assembly 83. The plunger assembly 83 includes a magnet 86 with two coaxially aligned rotating rotors 87, 87' mounted on the opposite ends of a rotating drive shaft. Each rotor 87, 87' is covered by a rotor cap 88, 88'. Disposed over each rotor cap 88, 88'is an illuminating end cap 90, 90', respectively. The two rotors 87, 87' are mounted on the drive shaft so that magnet 86, the two rotors 87, 87'and the two rotor caps 88, 88' move as a unit longitudinally between the two end caps 90, 90,' respectively.

Figure 14:
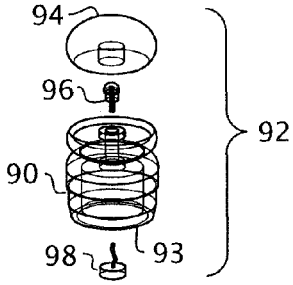
FIG. 14 is an exploded perspective view of an illuminating end cap used on the third embodiment.

The two end caps 90, 90' are securely attached to the ends of an inner tube 84. As shown in FIG. 14, each illuminated end cap (end cap 90 shown) includes an end cap body 92. Formed longitudinally inside the end cap body 92 is a recessed bore 93 in which the rotor cap 88 is inserted and may move longitudinally therein. Because the rotor cap 88 can spin freely around the drive shaft attached to the magnet 86, the magnet 86 is able to continue spinning inside the inner tube 84 when rotation of the end cap 90 is stopped. Coaxially aligned inside the recessed bore 93 is a Piezo electric transducer 94. Mounted on the outer opening of the bore 93 is an LED 96. Attached to the distal end of the end cap body 92 and mounted over the LED 96 is a protective transparent lens 98. During operation, the plunger assembly 83 moves back and forth inside the outer body 60 and suddenly stops as the opposite ends extend from the outer body 60. When movement to the plunger assembly 83 stops, the magnet 86 and two rotors 87, 87' and the two rotor caps 88, 88' continue to move longitudinally inside the inner tube 84 and impact the adjacent Piezo electric transducer 94 causing the LED 98 to briefly illuminate.

The devices 5, 5' and 5" measure approximately 5.8 cm in length. The outer bodies 10, 40, and 60 is made of non-ferric material and measures 3.9 cm in length and 2.6 cm in diameter. The plunger assemblies 20, 50, 83 and measures approximately 5.8 cm in length and 1.5 cm in diameter. In the first embodiment, the magnets 28, 28' are flat disk structures approximately 0.2 cm thick and 2.1 cm in diameter. The steel washers 18, 18' are approximately 0.2 cm thick and 2.2 cm in diameter. In the second and third embodiments, the outer and inner sleeves are made of non-ferric material. Also, the steel compression rings are approximately 0.2 cm in thickness and 2.3 cm in diameter and the magnets are approximately 1.2 cm in diameter and 2.4 cm in length.

In each embodiment, the size and strength of the magnets 28, 28', 56, and 86, may vary depending to the finger and hand strength of the user. It is believed that the magnets should resist a longitudinal force applied to the ends of the plunger assemblies between 1.0 to 1.5 lbs.

Operation

As show in FIG. 15, while holding the assembled device 5 in the palm of the hand 100, the user presses one finger 102 lightly but firmly on the exposed end cap. The pressing force gradually increases until it overcomes the attraction between the magnet 26 in opposite end cap 24 and the steel washer 18 located on the opposite side of center landing 16. The magnets 24, 24 and the steel washers 18, 18' (shown more clearly in FIGS. 3 and 4) are sufficiently spaced apart so that as the plunger assembly 20 travels longitudinally inside the center bore, it is not affected at a short distance by a magnetic field. Eventually, a magnetic force is created between opposite pairs of magnets 28, 28' and the steel washers 18, 18' that gradually pulls the end cap 21 into the outer body 10 and forces the opposite end cap 21' out of the outer body 10. Because the magnetic force increases as the magnets approach the adjacent washer, the plunger assembly 20 undergoes an acceleration. When the magnet housing is in contact with the steel washer 18, and slight impact is felt in the hand 100 and a relatively low volume "clicking" sound may be heard.

The second embodiment of the device 5' operates in the same manner but without the low volume 'clicking' sound.

In the third embodiment shown in FIGS. 7-14, the movement of the plunger assembly 83 is the same but the quality and nature of the sound and tactile sensations produced are enhanced. In the third embodiment, a low volume 'rolling' or 'grinding' sound is produced by the tonal rings 76, 78 and the ball bearings 74 and the Piezo electric transducer 94 and LED 96 provides a unique illumination effect each time the plunger assembly 83 moves back and forth inside the outer body 60.

In the above embodiments, one or more magnets are mounted on the plunger assembly and at least magnetic attractive substrates are mounted inside the outer body that produce two magnetic attractive forces that cause the plunger assemblies to move back and forth inside the outer body when manual force is applied to the extended end of the plunger assembly. It should be understood that the one or more magnets on the plunger assembly could be replaced by one or more magnetic attractive substrates and that the two magnetic attractive substrates mounted in the outer body could be replaced by two magnets.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A handheld finger manipulator device, comprising:

a. a cylindrical outer body designed to fit entirely into the palm of a hand of a user, said outer body includes a center bore and two opposite ends;

b. a cylindrical plunger assembly that fits inside and moves longitudinally inside said center bore, said plunger assembly being longer than said outer body so that one end of said plunger assembly is retracted into one end of said outer body, the opposite end of said plunger assembly extends from the opposite end of said outer body; and, c. at least one magnet located on said plunger assembly and at least two magnet attractive substrates affixed to said outer body, said magnet and said magnet attractive substrates being positioned and sufficiently spaced apart on said plunger assembly and said outer body, respectively, so that two magnet attractive forces are created between said outer body and said plunger assembly when said plunger assembly moves longitudinally in opposite directions inside said center bore, said magnet and said magnet attractive substrates creating sufficient magnetic force to hold said plunger assembly inside said center bore with one end extended therefrom yet allow said plunger assembly to be manually forced into said center bore a sufficient distance so that said magnet engages the other magnet attractive substrate to continue to move said plunger assembly in said center bore and the opposite end of said plunger assembly extends from said outer body.

2. The handheld finger manipulator device as recited in claim 1, wherein said plunger assembly is an I-shaped structure with two wide end caps spaced apart and each containing a magnet, and two transversely aligned steel washers located inside said outer body, wherein one end of said plunger assembly is retracted inside said center bore and the opposite end of said plunger assembly is extended, and said magnet in the retracted said end cap is magnetically attracted to one said steel washer.

3. The handheld finger manipulator device as recited in claim 1, wherein said plunger assembly includes a single, centrally located magnet located inside an inner sleeve and two ferric compression rings affixed inside said outer body, said magnet and said compression rings be spaced apart so that said plunger moves longitudinally back and forth in said center bore whereby one end of said plunger assembly is retracted inside said outer body and the opposite end of said plunger assembly is extended from said plunger assembly.

4. The handheld finger manipulator device as recited in claim 3, further including an outer sleeve located inside center bore and surrounding said plunger assembly.

5. The handheld finger manipulator device as recited in claim 3, further including an outer sleeve located inside center bore and surrounding said plunger assembly, said outer sleeve includes opposite flared ends that hold said compression rings inside said center bore.

6. The handheld finger manipulator device as recited in claim 5, further including at least one tonal ring located inside said center bore and surrounding said outer sleeve and a plurality of steel ball bearings located thereon that roll against said tonal ring when said magnet moves longitudinally inside said center bore.

7. The handheld finger manipulator device as recited in claim 1, further including illuminating end caps attached to said plunger assembly.

8. The handheld finger manipulator device as recited in claim 1, wherein said illuminated end caps are activated when said plunger assembly decelerates inside said center bore.

9. A handheld finger manipulator device, comprising:

a. a cylindrical outer body with a center bore and two opposite ends;

b. two compression rings made of ferric material located inside said center bore and located at said opposite ends of said outer body;

c. a cylindrical plunger assembly that moves longitudinally inside said center bore, said plunger assembly includes two end caps and being longer in length than said outer body so that one said end cap extends from said outer body and an opposite said end cap is retracted inside said outer body; and, d. a magnet located centrally on said plunger assembly between said end caps, said magnet being sufficiently attracted to said compression rings so that said plunger assembly is held within said center bore with one said end cap extending outward from said outer body and an opposite said end cap is retracted in said outer body, said magnet also being sufficiently attracted to said compression rings so that when said magnet is adjacent to one said compression ring, the extended end cap on said plunger body may be manually forced into said center bore moving said magnet towards the opposite said compression ring until the magnetic force between said magnet and said opposite compression ring continues to move said plunger assembly longitudinally inside said center bore.

10. The handheld finger manipulator device as recited in claim 9, wherein said plunger assembly includes an inner sleeve made of non-ferric material that extends between said end caps and surrounds said magnet.

11. The handheld finger manipulator device as recited in claim 9, further including an outer sleeve located inside center bore and surrounding said plunger assembly, said outer sleeve includes opposite flared ends that hold said compression rings inside said center bore.

12. The handheld finger manipulator device as recited in claim 11, further including at least one tonal ring located inside said center bore and surrounding said outer sleeve and a plurality of steel ball bearings located thereon that roll against said tonal ring when said magnet moves longitudinally inside said center bore.

13. A handheld finger manipulator device, comprising:

a. a cylindrical outer body designed to fit entirely into the palm of a hand of a user, said outer body includes a center bore and two opposite ends;

b. a cylindrical plunger assembly that fits and moves longitudinally inside said center bore, said plunger assembly including two opposite ends and being longer than said outer body so that one said end of said plunger assembly is retracted into one end of said outer body and the opposite said end of said plunger assembly extends from the opposite end of said outer body;

c. a first means for generating a magnetic force disposed between said outer body and said plunger assembly that causes said plunger assembly to sufficiently move longitudinally inside said center bore so that one said end of said plunger assembly extends from said outer body and the opposite said end of said plunger assembly is retracted within said outer body;

d. a second means for generating a magnetic force disposed between said outer body and said plunger assembly that causes said plunger assembly to move longitudinally inside said center bore and in the opposite direction of movement caused by said first means for generating a magnetic force; and, e. whereby when one said end of said plunger assembly is extended from said outer body by one of said first or second means for generating a magnetic force, and is then forced into said center bore, the other first or second means for generating a magnetic force causes the plunger assembly to continue to move longitudinally in said center bore until the opposite end of said plunger assembly is extended from said outer body.

* * * * *